United States Patent [19]

Zaman et al.

[11] Patent Number: 4,601,918

[45] Date of Patent: Jul. 22, 1986

[54] APPARATUS AND METHOD FOR APPLYING HIGH SOLIDS ENAMELS TO WIRE

[75] Inventors: Mohammad F. Zaman; Dennis L. Peppler, both of Fort Wayne, Ind.

[73] Assignee: Essex Group, Inc., Fort Wayne, Ind.

[21] Appl. No.: 769,902

[22] Filed: Aug. 27, 1985

[51] Int. Cl.[4] ..... B05D 5/12

[52] U.S. Cl. ..... 427/120; 427/428; 427/429; 118/264; 118/266; 118/268; 118/271; 118/234

[58] Field of Search ..... 427/120, 428, 429; 118/264, 266, 268, 271, 234

[56] References Cited

U.S. PATENT DOCUMENTS

| | | | |
|---|---|---|---|
| 2,032,950 | 3/1936 | Newton et al. | 91/39 |
| 3,034,477 | 5/1962 | Williams | 118/223 |
| 3,199,492 | 8/1965 | Latour | 118/123 |
| 3,412,709 | 11/1968 | Goyffon | 118/405 |
| 3,877,414 | 4/1975 | Brideau | 118/266 |
| 4,258,646 | 3/1981 | Kloczewski et al. | 118/50.1 |
| 4,356,218 | 10/1982 | Chiu | 118/266 |

FOREIGN PATENT DOCUMENTS

| | | | |
|---|---|---|---|
| 1947890 | 10/1970 | Fed. Rep. of Germany | 118/266 |

*Primary Examiner*—Richard Bueker

*Attorney, Agent, or Firm*—Alan C. Cohen

[57] ABSTRACT

The present invention discloses a method and apparatus for applying high solids enamels to wire wherein the enamel is heated to lower its viscosity to below about 200 cps, the heated enamel is then passed through a discrete, enclosed passageway in a first felt pad. The wire to be coated is then drawn between the first felt pad and a second felt pad in contact with the first felt pad. The wire is passed substantially perpendicular and in front of the discrete passageway of the first felt pad when it is coated with the enamel. The enamel is then formed uniformly and circumferentially about the wire as it exits the felt pads and cured in a curing oven.

4 Claims, 4 Drawing Figures

APPARATUS AND METHOD FOR APPLYING HIGH SOLIDS ENAMELS TO WIRE

CROSS REFERENCE TO RELATED APPLICATION

Attention is directed to commonly assigned, copending U.S. patent application Ser. No. 719,395 filed Apr. 3, 1985.

TECHNICAL FIELD

The technical field to which this invention pertains is coating methods and apparatus, particularly apparatus for applying polymer insulations to magnet wire substrates.

BACKGROUND ART

There has been a general trend in the coating art to utilize polymer systems containing higher levels of solids content. Several benefits can be derived from such use. The enamels require less solvent addition during preparation, an energy reduction is available in the drying process, there is a potential for operating with fewer passes, and there is the possiblity for increasing spindle count. However, several problems become apparent when higher solids enamels are utilized on conventional equipment.

For example in the die applied method, the viscous materials do not permit high wire speed, these dies are expensive and the viscous material, which is constantly being recycled, entraps air readily, thereby creating an inferior wire product.

A roller applied coating apparatus is used in some installations. The wire is coated with an excess of enamel by a roller and is subsequently introduced to a series of wiper rolls. A relationship between the roller speeds and wire speed exists whereby some of the enamel is removed leaving the desired wet enamel distributed around the wire. This method requires a low viscosity enamel for best results as a highly viscous material would not flow easily from the roller to the wire. The large exposed surface area of the rollers, coupled with rollers turning several hundred RPM makes this system costly and environmentally dangerous due to large solvent evaporation. Once again, with higher solids coatings, the viscosity increases rapidly with the loss of solvent, and the recirculation of relatively large quantities of enamel can cause excessive air entrapment and contamination. Precise viscosity control is required with the roller system and the excessive evaporation makes the system sensitive and requires additional amounts of a solvent blend to be added to compensate for the losses.

DISCLOSURE OF INVENTION

The present invention is directed toward a method and apparatus capable of resolving problems associated with the use of higher solids content enamels. This particular apparatus offers a number of beneficial features which improve the operation over previous felt applicator systems. The method comprises heating the high solids content, viscous enamel to reduce its viscosity to below about 200 cps. The heated enamel is then metered into the enamel applicator through a discrete passageway in one felt pad to the wire where it is applied as the wire passes between the first pad and second pad. The wire continues between the felt pads which distributes the enamel around the wire. The coated wire is then subsequently passed through a conventional curing oven and cured. The enamel utilized may have a solids content as low as 6% to a high of about 100% which may be heated to lower its viscosity below 200 cps without damaging the enamel or the wire.

The apparatus comprises a body having at least one enclosed passageway therethrough, said passageway having an inlet and an outlet. A first soft, elastic, porous pad having a discrete enclosed passageway therethrough affixed to said body, said pad being positioned on said body such that the passageway of the body and the passageway of the pad form a continuous passageway. A second soft, elastic porous pad and a means for mounting said second pad in face-to-face engagement with said first pad. A means for guiding said wire between said pads such that the wire passes substantially perpendicular and in front of the passageway. The elasticity of the pads being such that each thereof yields to partially encompass said wire thereby substantially, circumferentially surrounding said wire. A means for heating said high solids wire enamel to lower its viscosity to a predetermined viscosity. A means for metering said heated enamel into and through the body passageway, through the pad passageway, thereby forming a pool of heated enamel between the two pads, through which the wire is drawn, thereby coating said wire with the enamel.

The foregoing description and other beneficial features and advantages of the present apparatus will become more apparent from the following description and accompanying drawings.

BEST MODE FOR CARRYING OUT THE INVENTION

Figure 1:
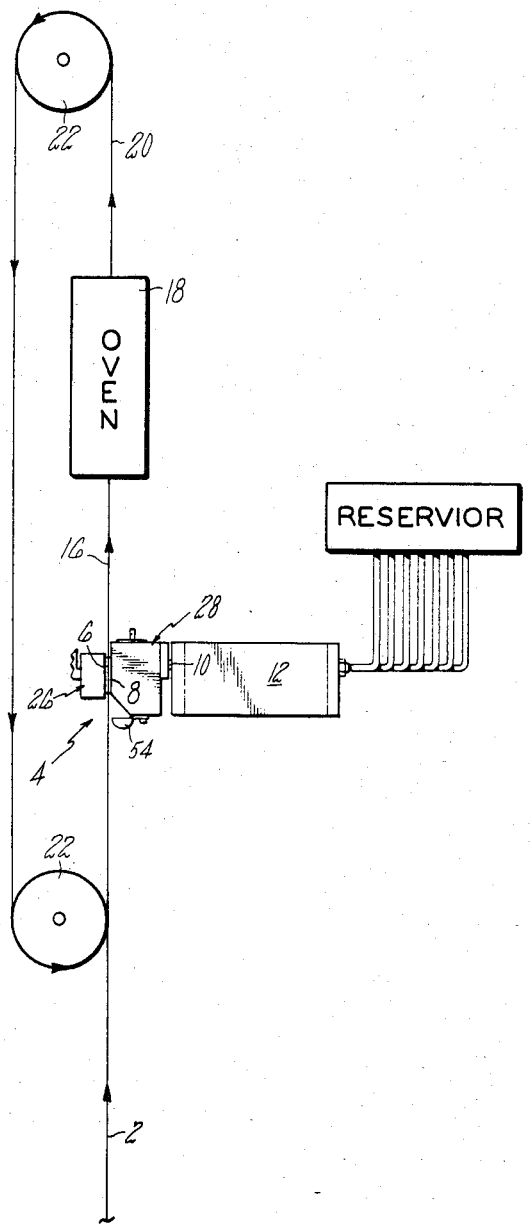
FIG. 1 shows a schematic of the present apparatus in the enameling process.

The wires coated according to the present invention are conventional magnet wire substrates, e.g., copper or aluminum and while not limited to any particular size, are typically wires ranging anywhere from 20 AWG (0.032 inch) to 50 (0.001 inch) (American Wire Gauge) in diameter, with wire sizes about 22 AWG (0.0253 inch) to about 36 AWG (0.0050 inch) being the most preferred wire. Wire coatings anywhere from about 0.05 mil to about 3 mils in thickness can be applied. Typically, the coating is applied in a series of passes, each pass adding another layer of enamel onto the wire. Typically, with wires of this diameter, each pass will apply about 0.025 mil to about 0.25 mil and most typically, it will be 0.20 mil. The amount of material placed on the wire at any one pass will, of course, be a function of the type of coating compositions used and its viscosity. The apparatus is capable of operation with different and separate enamels to build the desired product layer by layer. Two separate enamels, a basecoat and a topcoat, constitutes a typical setup. However, the apparatus can be configured for a different material in each pass if desired.

These coatings can be used as a sole insulation coat or part of a multi-coat system in combination with other conventional polymer insulation. Typically, these wires are coated with polyurethane basecoats and THEIC polyester basecoats (note U.S. Pat. Nos. 3,342,780; 3,249,578; and also commonly assigned U.S. Pat. No. 4,476,279 the disclosures of which are incorporated by reference) with polyamide or polyamideimide overcoats. Other polymers useful with the present invention include polyester, polyamideimide, polyamide, polyurethane, polyepoxide, polyesterimide, polyimide and polyvinyl formal (note U.S. Pat. No. 4,374,221). The important physical feature of the polymers selected for these coatings is that they be capable of having their viscosities lowered to below 200 cps through heating without deteriorating the final enamel. The basecoat to topcoat ratios are typically from 60–90:40–10.

The polymers of the present invention can also contain lubricants either externally on the coating, internally in the coating or both. A typical external lubricant comprises equal amounts of paraffin, beeswax and vaseline in roughly equal amounts applied out of conventional solvents. The enamels can be cured by passing through conventional curing ovens with typical inlet oven temperatures of about 400° F. (204° C.) to about 900° F. (482.2° C.), preferably about 650° F. (343.3° C.) and outlet temperatures of about 500° F. (260° C.) to about 1100° F. (593.3° C.) and preferably about 800° F. (426.7° C.). However, other enamels may be developed which require higher or lower curing temperatures and may also be used if their viscosities can be lowered to the requisite cps without ruining the resin.

As stated above, the solids content of the polymers should be about 6% to about 100% by weight. There is virtually no limit on the viscosity or solids content of the enamel used, so long as its viscosity can be lowered by heating the enamel to less than about 200 cps and will maintain that viscosity until applied to the substrate. Enamels having viscosities as high as 120,000 cps or greater at 86° F. (29.7° C.), may be employed using this invention. The wire itself may be heated as well, although this is not a requirement. In addition to maintaining the viscosity of the enamel, the elevated temperatures will also reduce the energy required to cure the enamel in the ovens.

Typically, the enamel is heated to temperatures ranging from about 120° F. (48.9° C.) to about 300° F. (148.9° C.), thereby reducing the viscosity to below about 200 cps. However, these temperatures should not be limiting as the enamel may be heated to any temperature which does not cause it to react prematurely so as to result in an unacceptable final product, or to produce an enamel wherein the solvent is boiled or driven off prematurely, thereby increasing the viscosity to an unacceptably high level.

The preferred manner of raising the enamel's temperature may be in a fully controllable stepwise method whereby the enamel is warmed gradually through heat traced transport lines, it is then heated to an intermediate temperature in the separately controlled enamel heat exchanger, and finally increased to full application temperature in the applicator manifold. All zones may be separately isolated and controlled. This feature allows for a controlled retention time at the higher potentially detrimental temperatures. In this way, the enamel in effect sees only instantaneous excessive heating at the exact point of application. However, this is only the preferred method of raising the enamel temperature and any manner of heating or raising the temperature to lower its viscosity to the desired level may be employed so long as it does not damage the enamel or reduce the quality of the finished magnet wire. After the enamel has been heated, the enamel is then directed through a discrete passage in a felt pad so that it is directed directly to the wire. This removes the requirement that the enamel has to wick through the pad, thereby overcoming the problem associated with the prior art. The enamel may now be applied in a precisely controlled manner and results in an improved wire with fewer passes and higher wire speeds.

The felt pads which may be used to practice this invention may be any of the commercially available felt pads such as wool, acrylic, polypropylene, polyester, etc. These felt pads sould have a density when compared to woolen felt pads of about F-1 to about F-10 with a density of about F-5 being preferred. This is equivalent to a specific gravity of about 0.181 gm/cc to about 0.342 gm/cc based on a 100% wool sample.

The woolen felt pads may be either pressed felt pads or woven structures while the synthetic felt pads are generally needled.

The size of the passage in the felt is not critical, however, it should be large enough to allow sufficient enamel to pass through without creating too high a back pressure, as this would interfere with the metered flow of enamel to the wire. In addition, such high pressures may not necessarily result in an undesirable wire product, but may cause the enamel to be forced out of the applicator resulting in lost enamel and messy dies. Low pressures below about 5 psi are desirable but it should not be limited to these pressures.

FIG. 1 is a schematic of the overall method of applying the heated enamel to the wire substrate. In this schematic the wire 2 is drawn through the enamel applicator 4 and between two felt pads 6 and 8. The enamel is introduced into the enamel applicator 4 through connection 10. The enamel may have been preheated prior to being introduced into the enamel applicator 4 or it may be heated after introduction. The preferred method is to warm the enamel in a reservoir outside of the applicator body to an intermediate temperature then pass the warmed enamel through a heat exchanger 12 raising the temperature nearly to that of the temperature required for application and then finally heating the enamel to its final temperature once it has been introduced into the enamel manifold 30. All of the methods of heating and thermal control are conventional. The gradual increase in enamel temperature allows for controlled retention times at the higher potentially detrimental temperature which may be desired for application of the enamel to the wire. In this way, the enamel, in effect, sees only limited time at the highest temperature at the point of application to the wire.

The wire 2 is drawn between the felt pads 6 and 8 and through an enamel pool (not shown) developed between the felt pads, thereby coating the wire with the enamel. The coated wire 16 is then drawn between the the felt pads as it exits wherein the excess enamel is removed from the wire and the remaining enamel is uniformly and concentrically distributed about the wire.

The coated wire then passes through a conventional curing oven 18 where the enamel is cured. After exiting the oven 18, the cured wire 20 is turned about on a series of shives 22 and is directed back through the enamel applicator 4 and a second felt pad applicator portion of the enamel applicator (not shown) having the same or a different enamel coating which is then applied to the wire in the same manner as the first enamel coating. The coated wire 20 is again cured through the same process and may again be directed back through the applicator and recoated once again. This coating process may continue for as many passes as is required to produce a wire having the appropriate enamel thickness and/or distinct layers of insulation.

Figure 2:
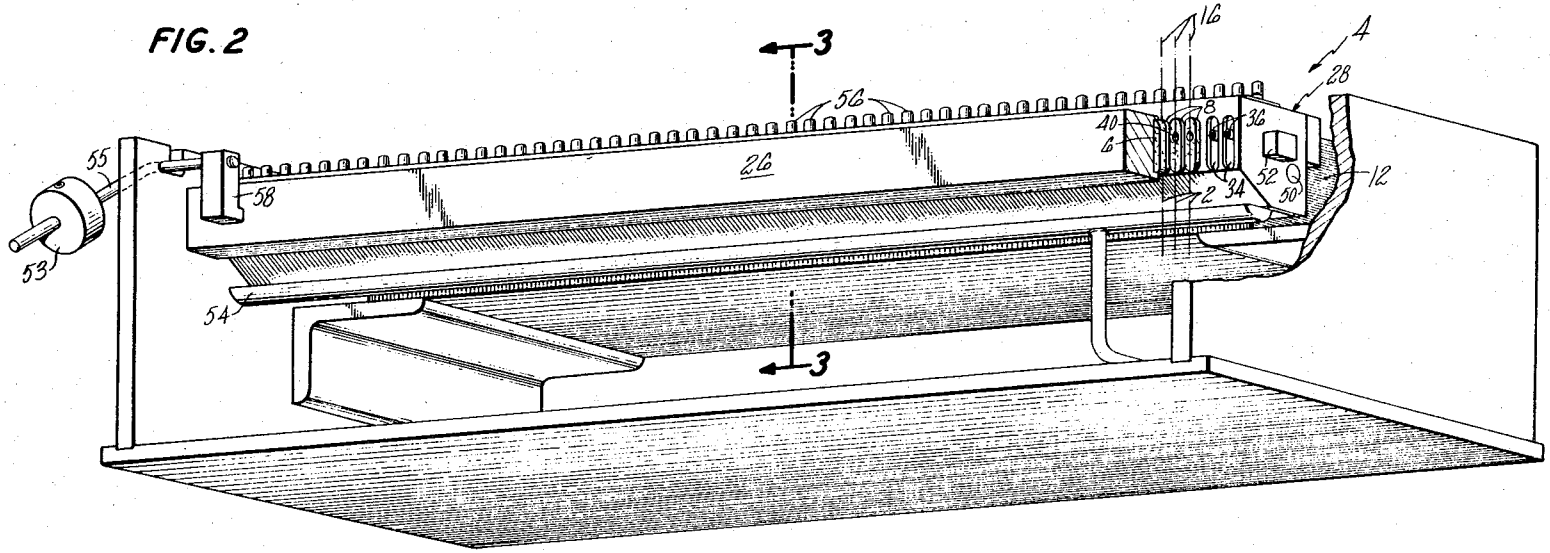
FIG. 2 shows the enamel applicator.
Figure 4:
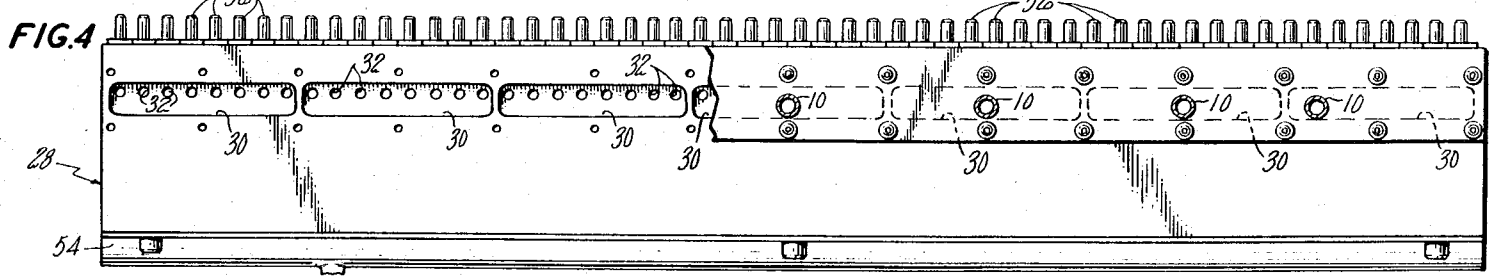
FIG. 4 shows the rear section of the enamel applicator.
Figure 3:
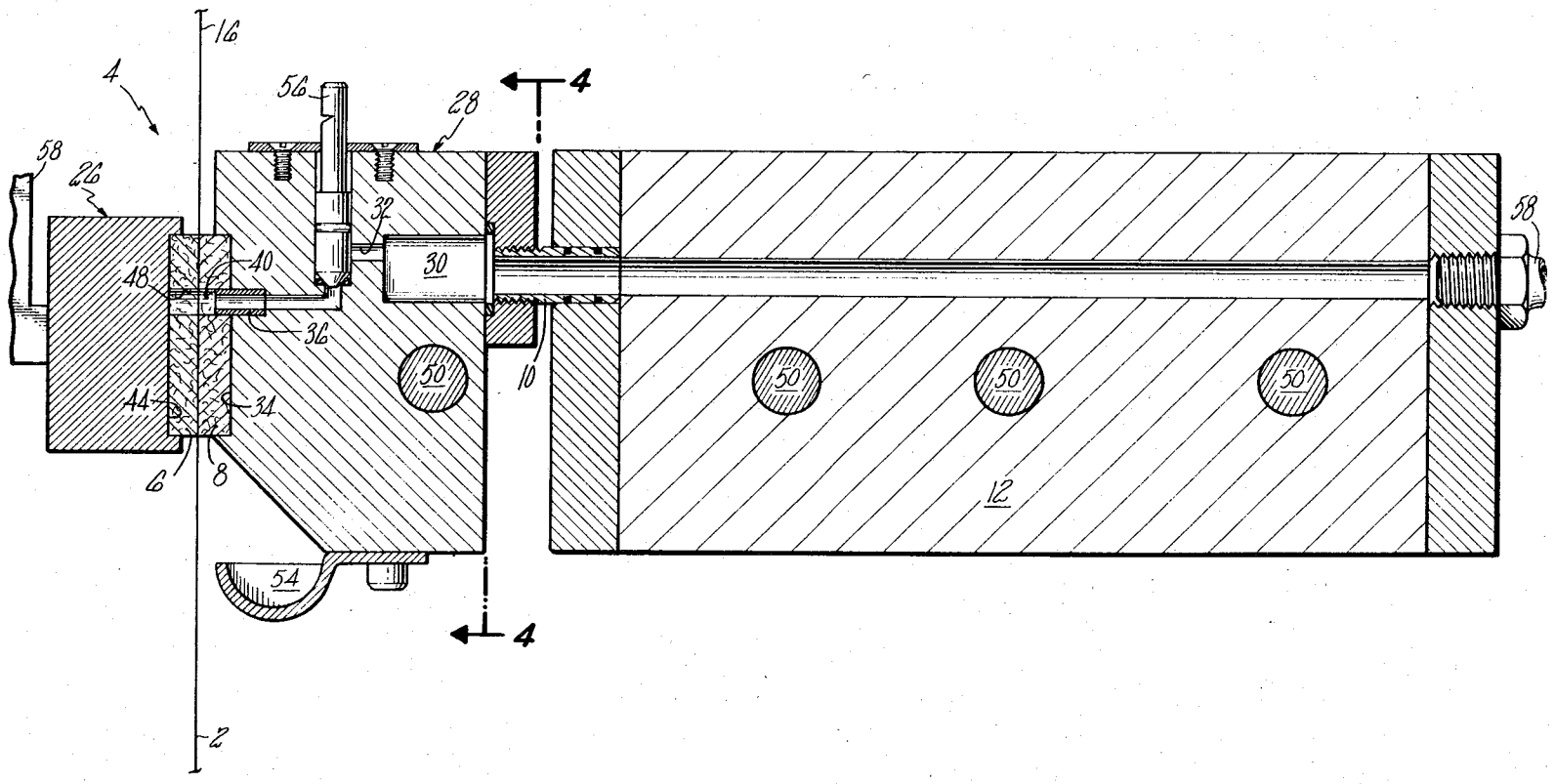
FIG. 3 shows a cross section of the heater and enamel applicator.

A principal advantage of this invention lies in the use of the applicator in the manner in which the enamel is directed onto the wire. Referring now to FIGS. 2, 3 and 4, which is the preferred embodiment of the applicator and is not meant to be limiting, but merely exemplary. The applicator (FIG. 2) comprises an enamel applicator 4 in the form of a top portion 26 and a bottom portion 28. Each of these portions may be made of metal i.e. aluminum, steel, etc. or high temperature plastics. The primary physical characteristics determining the particular material to use in these and all of the applicator components is that they must be thermally stable in the operating temperatures of the apparatus and it must be compatible with the enamel and solvents being applied to the wire. The bottom portion 28 contains a plurality of manifolds 30 machined or molded into the body of the bottom portion 28 into which enamel may be fed. FIG. 4 depicts a bottom portion 28 with seven separate manifolds 30. Each manifold 30 has a plurality of passages 32 leading from the manifold to a plurality of chamfered insets 34 on the face of the bottom portion 28. Preferably these passages are aligned with a tubular structure 36 which extends above the floor of the chamfered set 34. There may be any number of tubular passages per manifold depending on the number of wires to be coated in any one pass. Each manifold has its own enamel feed through which heated enamel may be introduced into the manifold. In each of the chamfered insets is inserted a felt pad 8. The felt pad 8 contains a discrete, enclosed passage 40 that is substantially perpendicular to the direction of the wire 2. The passage through the pad is aligned in series with the tubular passage from the manifold. This allows for the direct flow of heated enamel from the manifold to the wire.

An advantage of the chamfered insert and the individual felt pad is that they ensure that cross contamination is minimized and allow for the changing of individual felt pads due to damage, wear, or general clogging. The separate cavities and felt pads also contain the individual enamel flow in case of wire breakage. For instance, if the felt pads were continuous for all wires in all passes and a wire break occurs then the excess enamel being supplied to the broken wire location is immediately accepted by the neighboring wires on each side. This excess build creates dimensional problems with the particular neighboring wires. Whereas with individual separate cavities and felt pads, the excess enamel will only continue to feed the cavity in question and may eventually drip into drip tray 54.

The top portion of the applicator 26 is a mating piece to the bottom half 28 having matching chamfered insets 44 and felt pad 6 (FIG. 3). Although it is not necessary, it is preferred that the felt pads of the top part also have a discrete enclosed passage 48 through it which aligns with the passage 40 of the bottom felt pads. The function of this passage is that when the enamel is metered into the manifold under pressure, the enamel is then directed through the tubular passage of the manifold 32 through the passages in the bottom felt 40 to the passage of the second felt 48. Where the two felt pads contact each other, and the enamel passes from one felt pad to the other, a pool of enamel exists (not shown) at the interface of the two felt pads. This is desirous so that when the wire, which is drawn between the pads and substantially perpendicular to the pad passageways, it will pass through the pool of enamel and become completely coated.

The bottom portion 28 of the enamel applicator 4 may contain calrods 50 used for heating the enamel and maintaining the applicator at a sufficient temperature to allow easy application of the enamel to the wire. However, other heating means may be employed, i.e. heating tape, etc. The top portion and the bottom portion of the enamel applicator are locked in position on the wire machine via the two flanges 52 attached to either side of the die body. Additionally, the felt pads are kept in contact and under a sufficient pressure to make them conform about the wire so as to substantially circumferentially surround the wire. The amount of pressure will vary depending on the type of felt used, the size of the wire and the amount of enamel applied per pass. Any number of methods may be used to maintain such pressure, i.e. torque screws, etc. The preferred method (FIG. 2) is the use of a lever arm 55 with a weight 53 attached thereto whose position may be varied along the arm, thereby varying the amount of pressure applied to the felts through the pressure bar 58

FIG. 3 shows a cross-sectional view of the invention where the wire 2 is being coated with enamel while advancing in the vertical direction at constant speed. The wire is sandwiched between two felt pads 6 and 8 with enamel being supplied through an tube 32 at constant flow rate by use of metering pumps (not shown). The rate at which the enamel is pumped or metered into the die applicator is easily calculated and is a function of the solids content of the enamel, the wire speed and the thickness of the enamel coating being applied. Any conventional metering device which is compatible with the enamel and its solvents (if any) may be used.

The orifice tube 36 is projected partially through hole 40 in the rear felt pad 8. This feature is extremely beneficial in that it provides for free flow of enamel directly to the wire which reduces the reliance upon the felt wicking characteristics. Also, front felt pad 44 can be a duplicate of the rear felt pad and the hole 48 aid in forming a pool of enamel to be formed around the wire. This small pool ensures complete wetting of the entire wire circumference prior to entering the upper distributing section of the enamel applicator near the exit of the felt sandwich. Enamel leakage is not a problem due to the hydrodynamic effect of the rapidly moving wire and the introduction of the enamel more nearer the felt exit.

There is a valve 56 to control the flow of enamel from the manifold to the individual felt pads and thus a valve for each wire location. The valves allow for individual enamel stoppage to any individual passageway 32 in case of a wire breakage. In the event that a wire should break, the flow of enamel to that felt pad may be stopped. This will result in an increase of enamel to the other pads connected to that manifold. However, this excess may be small, particularly when a large number of wires are being coated on one manifold, or the metering of the enamel may be adjusted. This feature allows for the excessive flow to be divided equally among the other wire locations in each pass. It is obvious that if the number of wire lines is high, then this small excess of enamel is of no consequence. However, should this increase be significant, one only needs to adjust the metering pump to compensate for the decrease in enamel being applied to the substrate in order to maintain proper thickness on the wire.

The enamel heat exchanger 12 heats the enamel just prior to introduction into the applicator. The enamel enters the heat exchanger 12 at inlet port 10. The path of the enamel through the heat exchanger is such that it provides enough residence time to reach the desired temperature before entering the manifold 30. The enamel heat exchanger 12 and manifold 30 are provided with a heat source such as calrod or cartridge heaters 50. For the purpose of FIG. 3 cartridge heaters are shown. However, other means of heat are certainly available to this apparatus such as circulating hot water or hot oil. Independent temperature controls are supplied for the heat exchanger and manifold block.

In the case of enamel change or cleanup, a cleaning solution can be pumped into inlet port 58 of the enamel heat exchanger 12. The solution flows through the entire enamel path and is collected in drip tray 54. The tray may also be used to catch and recycle excess enamel. Means are also provided for quickly changing the system. FIG. 2 shows that the assembly of enamel applicator 4 is held in position by a retaining tab 52 which is part of the enamel applicator embodiment. The retaining tab 52 is inserted in the "L" slot (not shown) and locked in place by a screw assembly.

A number of advantages are achieved using the present apparatus and method. First the prior art methods require that the enamel be recirculated during the enameling process. The recirculated enamel would have air and possibly other impurities entrapped in it when applied to the enamel reducing the insulating effect of the coating. This method allows for the use of high solids enamel in the magnet wire enameling process which results in higher productivity, faster wire coating speeds, lower costs (less organic solvents) and lower environmental hazards (less organic solvents).

Although this invention has been shown and described with respect to a preferred embodiment, it will be understood by those skilled in this art that various changes in form and detail thereof may be made without departing from the spirit and scope of the clamed invention.

We claim:

1. An apparatus for coating a moving wire with a high solids wire enamel, comprising:

a body having a plurality of enclosed passageways leading from one or more manifolds to a plurality of outlet ports on a surface of the body;

a plurality of first soft, elastic, porous pads each having a discrete, enclosed pipe-like passageway therethrough; and individually attached to the body such that the outlet port is in alignment with the passageway of the pad;

a plurality of second, soft, elastic, porous pads positioned in contact with said first pad thereby forming a guide for the wire to pass between and in contact with said pads such that the wire passes substantially perpendicular to and in front of the passageway, and is substantially, circumferentially surround by said pads;

said first and second pads being shaped to form a cavity between said pads connected to said pipe-like passageway;

a means for drawing said wire to be coated between said pads;

a means for metering a heated, high solids enamel into said manifold under controlled pressure thereby forcing the heated enamel through said passageways, through the first pad pipe-like passageway thereby forming a pool of heated enamel in said cavity between said pads through which the wire maybe drawn and coated.

2. The apparatus of claim 1 wherein the second pad has a discrete, enclosed passageway having a diameter at least as large as the diameter of the wire to be coated aligned in series with the passageway of the first pad.

3. The apparatus of claim 1 wherein the enamel applicator has a means for prohibiting the flow of heated enamel to one or more of the plurality of passageway in the body without prohibiting the flow of said enamel to one or more of the other passageways.

4. A method of applying a high solids magnet wire enamel to a wire substrate comprising:

heating the enamel to lower its viscosity to below about 200 cps;

introducing the heated enamel into a manifold in a enamel applicator;

passing heated enamel through a discrete, enclosed passageway from the manifold to a discrete, enclosed pipe-like passageway through a first felt pad, passing a wire substrate substratially perpendicular to and in front of the discrete, enclosed passageway of the first felt pad and between the first felt pad and a second felt pad in contact with the first felt pad, wherein said pipe-like passageway is conntected to a cavity between said pads, heated enamel is passed through said pipe-like passageway into said cavity, and said wire passes through the enamel in said cavity thereby coating the wire with the enamel;

passing the wire through a curing oven to cure the enamel; and returning the wire to the applicator for successive enamel applications and cures.

* * * * *